United States Patent [19]

Hammerstein

[11] 4,042,005

[45] Aug. 16, 1977

[54] ROLLING SHUTTERS

[75] Inventor: Gerd Hammerstein, Haan, Germany

[73] Assignee: Carl Schnicks & Co., Haan, Germany

[21] Appl. No.: 665,262

[22] Filed: Mar. 9, 1976

[51] Int. Cl.[2] ..... E06B 3/14; E06B 3/20

[52] U.S. Cl. ..... 160/220

[58] Field of Search ..... 160/133, 220

[56] References Cited

FOREIGN PATENT DOCUMENTS

| | | | |
|---|---|---|---|
| 683,214 | 6/1966 | Belgium | 160/220 |
| 1,404,676 | 5/1965 | France | 160/220 |
| 1,373,508 | 8/1964 | France | 160/220 |
| 2,001,857 | 10/1969 | France | 160/220 |

*Primary Examiner*—Peter M. Caun
*Attorney, Agent, or Firm*—Karl F. Ross; Herbert Dubno

[57] ABSTRACT

A rolling shutter comprises bar-shaped elements which are hooked together by mortise and tenon-type joints in laterally contiguous relation to form a curtain which can be rolled up upon a drum above the lintel of a doorway or the like, the bars consist of synthetic-resin hollow profiles and the mortise is formed with a groove in which a flange of the tenon of the overlying bar engages to rigidify the curtain when the same is fully rolled. When the curtain is raised by drawing the upper bars upwardly, the flange pulls out of the groove to allow pivoting or articulated movement between the bars.

1 Claim, 3 Drawing Figures

ROLLING SHUTTERS

FIELD OF THE INVENTION

My present invention relates to rolling shutters and, more particularly, to rolling-shutter systems in which a plurality of bars are connected in laterally contiguous relationship to form a relatively rigid and closed curtain. More specifically the invention relates to hollow-profile rolling-shutter assemblies.

BACKGROUND OF THE INVENTION

For the purpose of this invention a rolling shutter is a structure which comprises a plurality of bar-like members or slats which are laterally articulated to one another or contiguously interconnected so that the assembly can be rolled up, coiled or wound upon a drum, mandrel or shaft, usually disposed above a lintel in a door structure. Such rolling shutters are used to close the fronts of stores and other business establishments as security devices; they may be used as garage doors or as warehouse or trucking-port doors, as partitions to subdivide large spaces and wherever a structural opening requires reinforcement or closure and wherever subdivision of a space is desired.

It has been proposed heretofore to provide the bars or slats in the form of extruded synthetic-resin hollow profiles, i.e. prismatic tubular structures in which an enlongated compartment is laterally closed for stiffening purposes. On opposite lateral edges the bar can be formed with a groove or mortise into which a tongue or tenon of the other edge of another bar can be fitted to form an articulation enabling each slat to rotate relative to the adjacent or laterally contiguous slat. The interfitting formations on the opposite lateral edges of the slats can lock together to form a rigid curtain or wall structure or can be loose so as to freely rotate at least limitedly relative to one another. The tongue member can be bent and formed on its free end with a flange which is received in a recess in the grooved portion of an adjoining bar. The grooved portion itself can be formed with an arcuate seat against which the tongue can rest to enable one slat to roll on the next within their common joint.

The synthetic-resin profile can be continuously extruded and cut to the desired length and hence can be manufactured relatively inexpensively.

In the German utility model (Gebrauchsmuster) 1,984,759, the flange-engaging surface and arcuate formation of the groove forms a transverse wall which lies substantially horizontally in a lowered condition of the curtain and, with the connecting member of the next lower slat, is closed. This arrangement is not statically as secure as desired, resulting in an assembly which is not always structurally satisfactory.

OBJECTS OF THE INVENTION

It is the principal object of the present invention to provide an improved rolling shutter whereby the above-mentioned disadvantages can be obviated.

Another object of the invention is to provide a rolling-shutter arrangement in which the junctions between slats are more finished-looking and structurally more stable.

Still another object of the invention is to provide a slat assembly, especially for rolling shutters, which is better able to withstand the rigors of use than the priorart assemblies without substantial increase in the materials used.

SUMMARY OF THE INVENTION

These objects and others are attained, in accordance with the present invention, with a rolling shutter in which the slats or bars are constituted of hollow profiles and are formed along one lateral edge with a tongue and along the opposite lateral edge with a groove receiving a tongue in which a wall of the groove or channel extends substantially vertically in the lowered position of the shutter and constitutes a partition to which runs a substantially diagonal wall, the latter being formed with a bend conforming to the bend in the tongue and enabling a tongue fitted into the channel to roll upon this substantially diagonal wall.

At the junction between the diagonal wall and the vertical partition, there is provided a groove which likewise opens substantially vertically in the lowered position of the shutter and receives a flange formed on the end of the tongue beyond its bent portion and defining the head of a T-formation therewith. Consequently, when the shutter is fully lowered and upper slats move downwardly with respect to lowered slats of the shutter, the flange at the end of each tongue is received snugly in a respective groove of the channel of the next upper slat to lock the slats rigidly with one another and prevent articulation at the joints.

Thus the locking-flange recess is formed in an intermediate wall which is provided in each synthetic-resin hollow-profile slat or bar and which opens in the direction of, but is spaced from, a limiting flange which may close at least in part the mouth of the channel. The bottom of this recess or groove is spaced from the upper surface of this limiting flange by a distance which exceeds the width of the T-shaped head formed on the free end of the tongue which is fitted into the channel.

The arcuate contact surface of the channel, with respect to the hollow-profile cross-section, is formed in a wall which constitutes a diagonal stiffening web, or part of a diagonal stiffening web, running to the partition and joining the same at the locking-flange recess.

According to a preferred feature of the invention, the diagonal stiffening member is constituted by the arcuate supporting flange upon which the arcuate portion of the tongue can roll, and a connecting-profile member.

The principal advantage of the system of the present invention, whereby a partition extends substantially vertically in the lowered position of the shutter and is connected by a channel-shaped formation forming the locking-flange recess, to the arcuate portion which in turn constitutes a diagonal reinforcing wall, is the improvement in the static stability of the slat and the joint between laterally contiguous slats.

Not only does the lateral stability increase, but the overall strength of each slat and the stability of the shutter in its locked condition (wherein the locking flanges are lodged in the respective grooves) is vastly improved. This increase in strength and stability is achieved without any material increase in the cost of the slat and the quantity of synthetic resin from which it is fabricated. In fact, the slats are of considerable stability even when the wall thickness of the hollow profile constituting the slat is small, i.e. the synthetic-resin material from which the slats are constituted are very thin.

Finally, the joint constitutes a labyrinth-type seal which prevents dirt and other undesirable materials from penetrating into the joint. Of course, the slats of the present invention, like those of the prior art, can be produced by extrusion.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
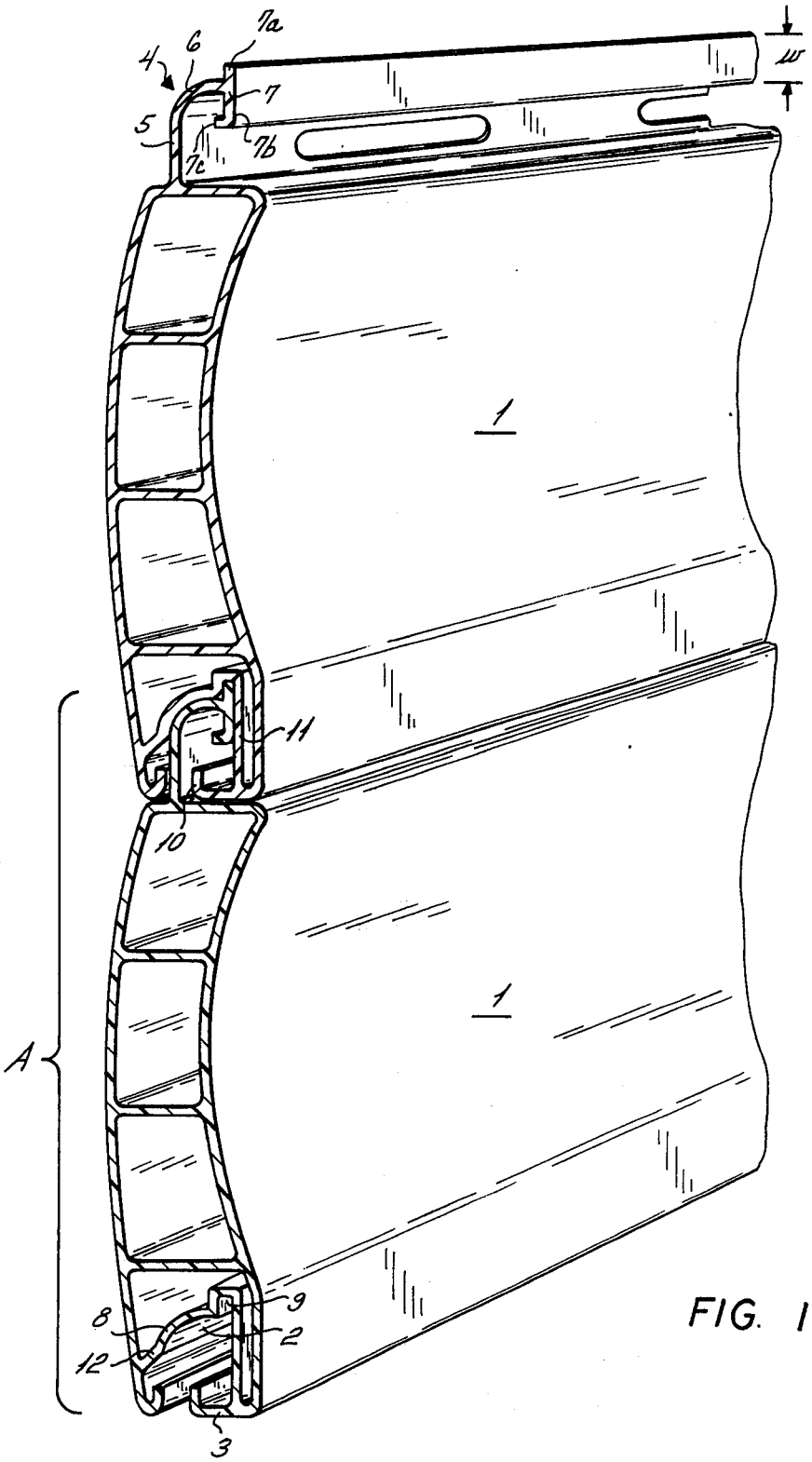
FIG. 1 is a perspective sectional view of an unrolled fragment of a shutter in which the adjacent slats are locked together against articulation.

In the drawing I have shown a rolling shutter which comprises a plurality of vertically stacked laterally contiguous synthetic-resin hollow-profile slats 1 which are laterally contiguous and joined together at articulated junctions which will be described in greater detail below.

Figure 2:
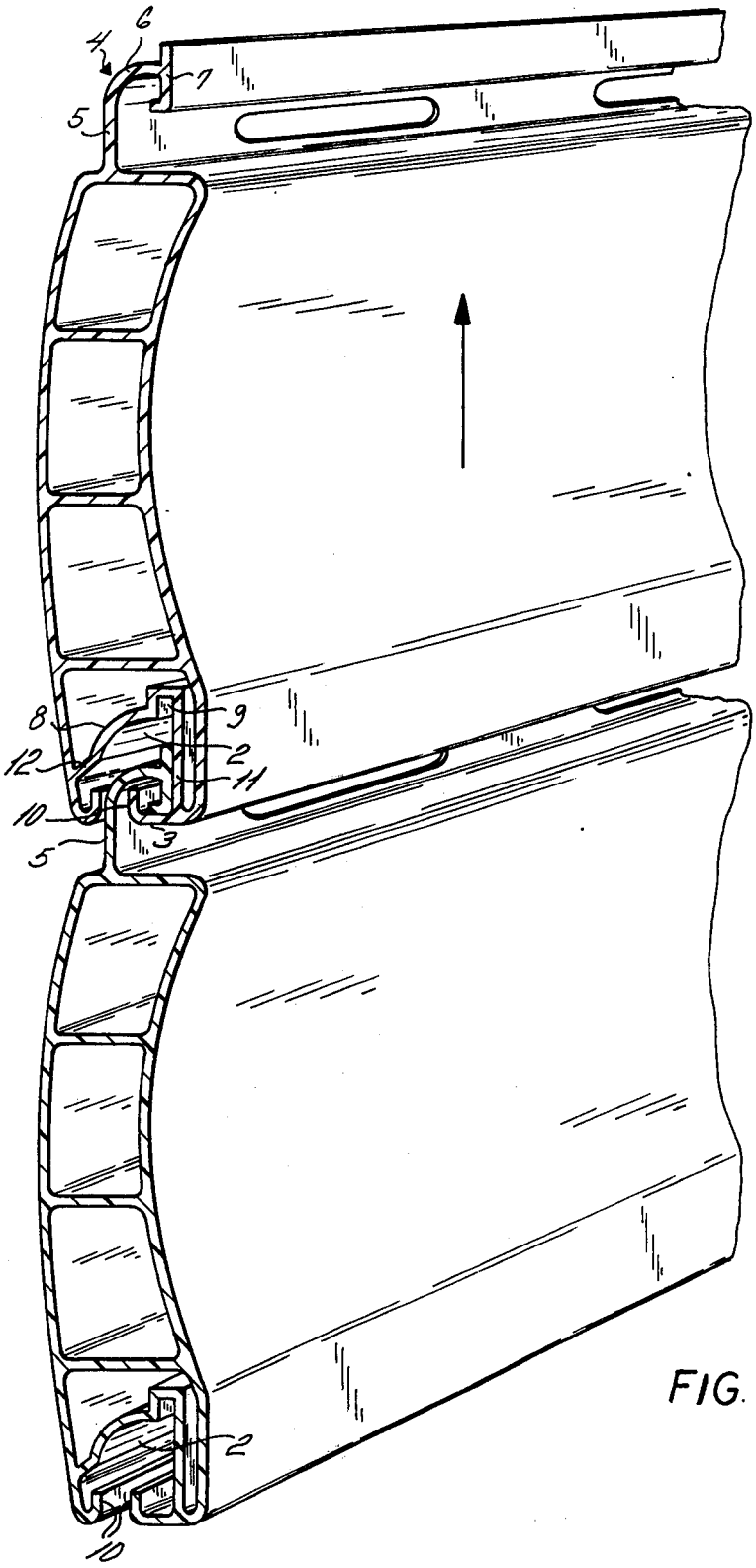
FIG. 2 is a view similar to FIG. 1 wherein, however, the joints are free to articulate because of a pull on the upper slats.

The shutter may be raised and lowered by any conventional mechanism (not shown) well-known in the art. As the shutter is raised, however, the upward force on each succesively higher slat tends to draw it upwardly against the gravitational force which holds the lower slats downwardly to permit the junctions to pull apart slightly and free them for articulated movement (compare FIGS. 1 and 2).

Each slat 1 is of a box-like construction and comprises an upper edge wall 1*a* from which a tongue 4 of the joint extends. The broad surfaces of the slat are formed by longitudinally extending walls 1*b* and 1*c* of greater and lesser curvature, respectively, the bottom of each slat being formed with a channel 2 adapted to receive the tongue 4 of the next lower slat.

The walls 1*b* and 1*c* are spanned by longitudinal partitions 1*d* and 1*e* which constitute reinforcing walls and subdivide the interior of each slat into cells having considerable stiffness even when the material from which the slat is composed is relatively thin.

The slat may have a wall thickness *t* which is less than the which T of a mouth 3*a* opening into channel 2 and defined between a pair of limiting flanges 3 forming the bottom of the slat.

The hook-shaped tongue 4 comprises a web 5 of the thickness *t* which has a right-angle bend at its upper end formed with an outer radius of curvature *r* and indicated at 6. At its free end, the tongue 4 is formed with a T-shaped head 7 constituted by a pair of vertically extending flanges 7*a* and 7*b* having an overall width *w*, the flange 7*b* being provided with a horizontal rib 7*c* so that the height of this rib is represented at *d* (see FIG. 3).

The hook-shaped tongue 4 and the channel 2 are so configured that together they form a pivotal joint or articulation which can be locked (FIG. 1) when each upper slat 1 is lowered relative to the underlying slat, or a free articulation (FIG. 2) when each uppermost slat is drawn upwardly relative to the next slat.

Figure 3:
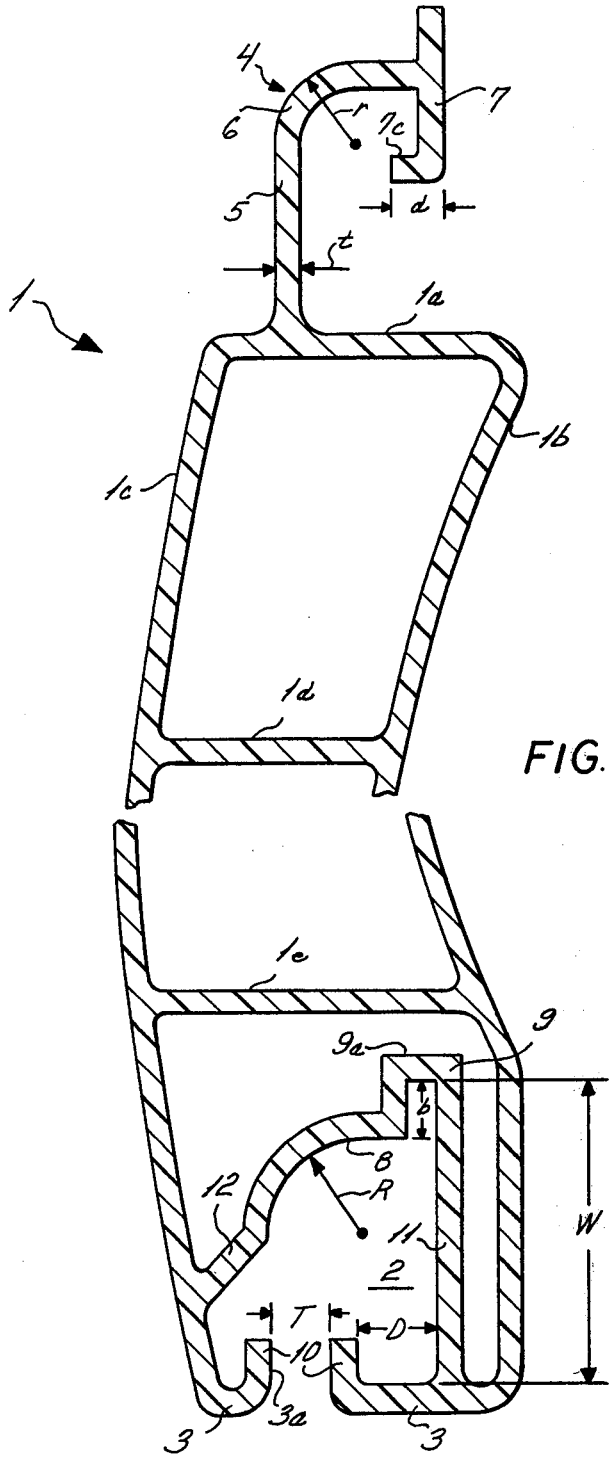
FIG. 3 is a fragmentary sectional view of a slat showing the same to an enlarged scale.

As will be especially apparent from FIG. 3, the hook-shaped tongue 4 comprises the web 5, the bent portion 6 and the locking flange 7 mounted on the bent portion 6, the entire tongue being formed monolithically, i.e. in one piece, with the remainder of the slat.

The channel 2 is formed with an arcuate supporting surface 8 which is bent to conform to the bent portion 6 of the tongue, i.e. has a radius of curvature R which is equal to *r*, and a groove-like receptacle 9, formed from a rectangular profile 9*a*, opening toward the limiting flanges 3. The base of groove 9 is spaced from the inner surface of the limiting flange 3 by a distance W which exceeds the width *w* of the flange 7.

Preferably, the depth *b* of the groove 9 is dimensioned with respect to the distance W and the width *w* such that $(W - b) > w$. The limiting flanges 3 are provided with upstanding reinforcing and abutment ribs 10. A distance D may be provided between a vertical partition wall 11 and the proximal rib 10, the distance D being greater than the height *d* of the rib 7*c* formed on the end of the lower flange member 7*b* of the head 7.

For the purposes of the invention it is important that the locking flange receptacle 9 be connected directly to the vertical partition wall 11 which is disposed within the cross section of each slat 1 and lies in a vertical plane when the slat is vertically oriented. Furthermore, the arcuate supporting surface 8, against which the arcuate portion 6 of the tongue 4 comes to bear (FIG. 1) forms part of a diagonal stiffening member which extends downwardly from the junction of the locking-flange receptacle 9 with the arcuate portion 8 and the partition 11. To complete this diagonal reinforcement, a connecting profile portion 12 is provided, this member 12 merging with the outer wall 1*c* of the shutter.

I claim:

1. A rolling shutter comprising a plurality of vertically superposed slats of hollow-profile construction and composed of synthetic-resin material, said slats being formed along their respective upper and lower edges with mating formations defining lockable articulations between laterally contiguous slats, one of said formations being formed as a channel and the other formation being formed as a tongue, said tongue having a web projecting vertically in a vertical position of said slat, an arcuate portion on said web and a substantially vertical flange on said arcuate portion, said channels each being formed with a planar vertical partition within the respective slat in a vertical position thereof, rising from a limiting flange defining the mouth of said channel and parallel to but spaced from an outer wall of said slat, a diagonal partition extending from the top of said vertical partition to another outer wall of said slat opposite the first-mentioned outer wall and formed with an arcuate supporting surface conforming to and adapted to bear against said arcuate portion of a tongue of an adjoining slat, and a flange-receiving groove at the junction of said partitions opening towards said limiting flange and adapted to receive the flange of said tongue of said adjoining slat, said flange of said tongue being formed as a T-shaped head on the end of said bent portion, said head lying substantially in a vertical plane parallel to and abutting over its entire width the respective vertical partition in a vertical position of the slat with said vertical partition supporting said head over its entire width to provide lateral stability to the shutter, the bottom edge of said head being formed with a horizontally extending rib, said limiting flange being formed adjacent the mouth of said channel with an inwardly extending rib, said diagonal partition being formed in part by a connecting profile member joining a wall of said slat with said arcuate surface, said horizontally extending rib having a width which is less than the distance between said inwardly extending rib and said vertical partition, said groove having a depth and a bottom spaced from said limiting flange by by a distance W such that $(W - b) > w$, where *w* is the width of said T-shaped head.

* * * * *